US005845426A

United States Patent [19]

Valorose

[11] Patent Number: 5,845,426

[45] **Date of Patent: *Dec. 8, 1998**

[54] TEN ROUND MAGAZINE WITH FIFTEEN ROUND PROFILE

[75] Inventor: Thomas Valorose, La Plata, Md.

[73] Assignee: Febbrica D'Armi P. Beretta, S.p.A., Gardone Val Trompia, Italy

[ * ] Notice: The term of this patent shall not extend beyond the expiration date of Pat. No. 5,704,148.

[21] Appl. No.: 906,848

[22] Filed: Aug. 6, 1997

Related U.S. Application Data

[63] Continuation of Ser. No. 631,932, Apr. 15, 1996, Pat. No. 5,704,148.

[60] Provisional application No. 60/003,027 Aug. 31, 1995.

[51] Int. Cl.[6] ..... F41A 9/71

[52] U.S. Cl. ..... 42/49.02; 42/7

[58] Field of Search ..... 42/7, 18, 22, 49.01, 42/49.02, 50

[56] References Cited

U.S. PATENT DOCUMENTS

| | | | |
|---|---|---|---|
| 506,323 | 10/1893 | Lee | 42/50 |
| 609,678 | 8/1898 | Johnson | 42/50 |
| 804,985 | 11/1905 | Searle | 42/7 |
| 1,348,172 | 8/1920 | Hammond | 42/50 |
| 3,623,256 | 11/1971 | Shiplee, III | 42/50 |
| 4,995,179 | 2/1991 | Switzer | 42/50 |
| 5,386,657 | 2/1995 | Racheli | 42/50 |
| 5,507,110 | 4/1996 | Chestnut et al. | 42/50 |
| 5,568,696 | 10/1996 | Mauch et al. | 42/49.02 |

FOREIGN PATENT DOCUMENTS

| | | | |
|---|---|---|---|
| 333250 | 2/1921 | Germany | 42/50 |
| 148470 | 1/1955 | Sweden | 42/50 |
| 8808113 | 10/1988 | WIPO | 42/50 |
| 9108435 | 6/1991 | WIPO | 42/50 |

*Primary Examiner*—Stephen M. Johnson

*Attorney, Agent, or Firm*—Schweitzer Cornman Gross & Bondell LLP

[57] ABSTRACT

A pistol magazine with the general external configuration of a 15 round magazine has longitudinal indentations projecting into the cartridge to reduce the maximum interior capacity to 10 rounds.

10 Claims, 2 Drawing Sheets

TEN ROUND MAGAZINE WITH FIFTEEN ROUND PROFILE

This is a continuing application of U.S. Ser. No. 08/631,932, filed on Apr. 15, 1996, now U.S. Pat. No. 5,704,148, which application claims priority of U.S. Provisional Application Ser. No. 60/003,027, filed on Aug. 31, 1995, now abandoned.

BACKGROUND OF THE INVENTION

With the enactment on Sep. 13, 1994 of the Violent Crime Control and Law Enforcement Act of 1994, magazines for pistols were restricted to ten rounds, other than those manufactured for law enforcement agencies and for government use. Pursuant to that legislation, magazines for civilian use were restricted in capacity to ten rounds and were required to be manufactured by stamping processes.

Accordingly, in order to comply with the requirements of the aforementioned legislation, it has become necessary for gun manufacturers to redesign or to otherwise modify existing magazines for more than ten rounds into magazines limited to a ten round capacity for civilian usage. It is to a new and improved design of a magazine, having the general geometry and overall profile of a fifteen round magazine (a now prohibited capacity for civilian use) but having a ten round capacity and being made by stamping to which the present invention is directed.

SUMMARY OF THE PRESENT INVENTION

In accordance with provisions of the present invention, a fifteen round 9 mm magazine, the use of which is now restricted by the new crime control legislation to government and police department, may be readily modified in such a manner as to reduce by one third its capacity, from fifteen 9 mm rounds to ten 9 mm rounds in such a manner as to accommodate its production by stamping techniques and in such a manner as not to greatly change its exterior geometry and configuration so as to make it readily compatible and readily usable in the weapons for which the fifteen round magazine was originally designed and with which the fifteen round magazine may still be readily employed. Existing magazines for different caliber ammunition, such as .40 or .45 caliber, may be similarly modified to reduce capacity to ten rounds.

Specifically, the internal geometry of the fifteen round magazine has been modified by provision of indentations extending on the outside walls of the magazine for substantially the whole height of the magazine in a manner whereby the series of ten rounds may be conventionally inserted within the magazine readily for upward biasing by a conventional spring-loaded follower mechanism. In accordance with the invention, the indentations in the side walls are of such predetermined size and shape so as to restrict the volume within the magazine to that limited ten rounds. In other words, the magazine of the present invention is made from a stamping which has the general overall configuration of a fifteen round magazine but which is provided with indentations on its major side walls which extend for virtually the entire height of the magazine and which are so configured as to leave a reduced inner cartridge holding volume which, while almost one third less than the earlier fifteen round volume, is so configured and restrained as to define a limited cartridge retaining volume in a specific shape which maintains ten cartridges in a vertical sinuous array within the magazine. More specifically, the inner geometry of the magazine is such that the ten rounds of the cartridge will be disposed one on top of the other, but with the center line of each successive cartridge offset from the center line of preceding cartridge in such as manner as to provide a single file of sinuously arrayed cartridges. The centerline-to-center-line vertical spacing of the ten cartridges is increased as is the diagonal relationship between successive cartridges. In this manner, a fifteen round magazine design may be converted into a ten round magazine for manufacture by stamping processes and thus will satisfy the requirements of the new statute. This type of stamping manufacture eliminates the possibility of conversion from a ten round capacity to illegal fifteen round capacity by improper means. The present ten round magazine design represents a very efficient and novel solution to the requirement for effective and economic compliance with the provisions of the Violent Crime Control and Law Enforcement Act of 1994.

For a better appreciation of the present invention, reference should be made to the following drawings taken in conjunction with the Detailed Description of the Invention.

DETAILED DESCRIPTION OF THE INVENTION

Figure 1:
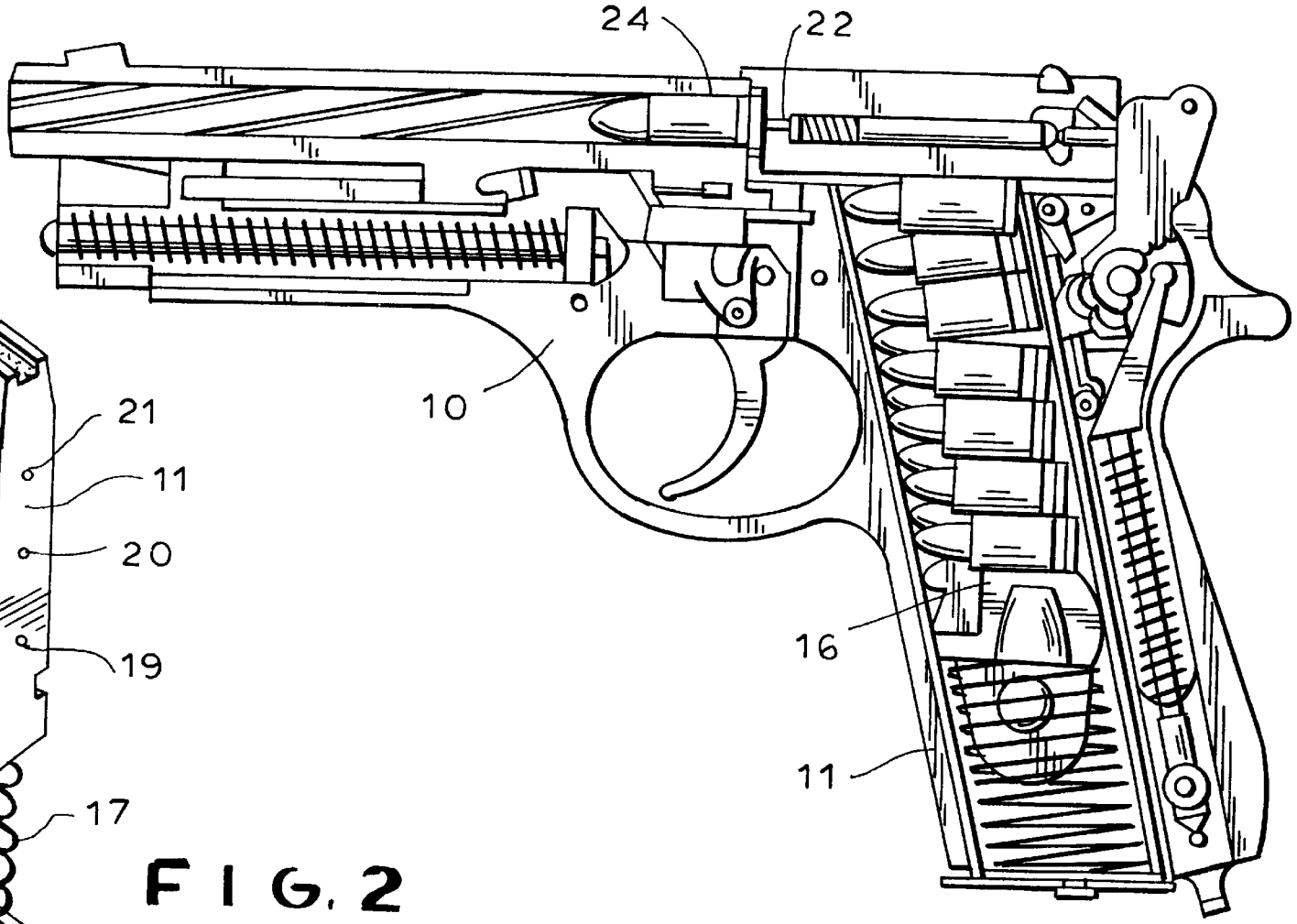
FIG. 1 is a cross-sectional view of a Beretta Model 92S pistol showing a fifteen cartridge magazine in place within the gun body.
Figure 2:
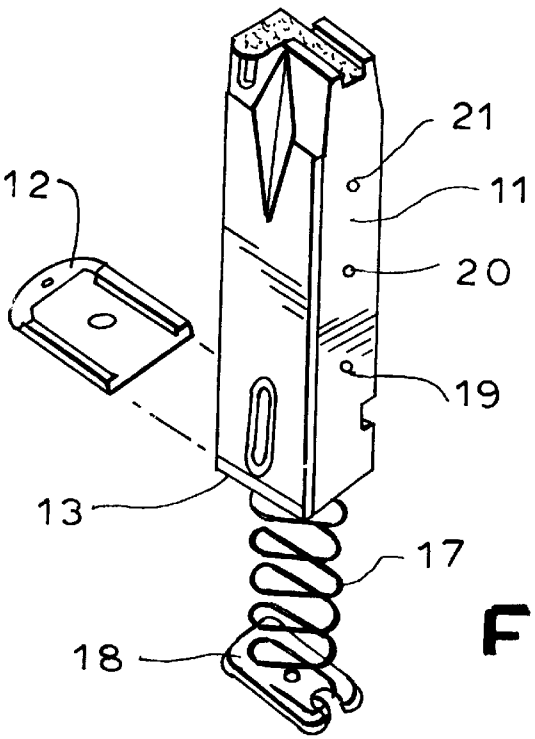
FIG. 2 is an exploded perspective view of a magazine for the Beretta 92S pistol shown in FIG. 1.

Referring now to FIG. 1, a typical Beretta 92 Series pistol is illustrated in which a gun body 10 is configured to receive a fifteen round magazine 11 in hollow handle portions thereof in known fashion. The fifteen round magazine 11 includes a base plate 12 which slides over outwardly extending flanges 13 after fifteen cartridges are loaded into the magazine, and a follower 16 biased by a follower spring 17 mounted on a magazine plate 18 is inserted into the magazine against its full load of fifteen cartridges, all in known fashion. Thus the typical fifteen round magazine for the 92 Series of Beretta pistols has the external geometry and configuration shown in FIG. 2, including three orifices 19, 20, and 21 indicating "fifteen", "ten", "five" cartridges remaining.

Figure 3:
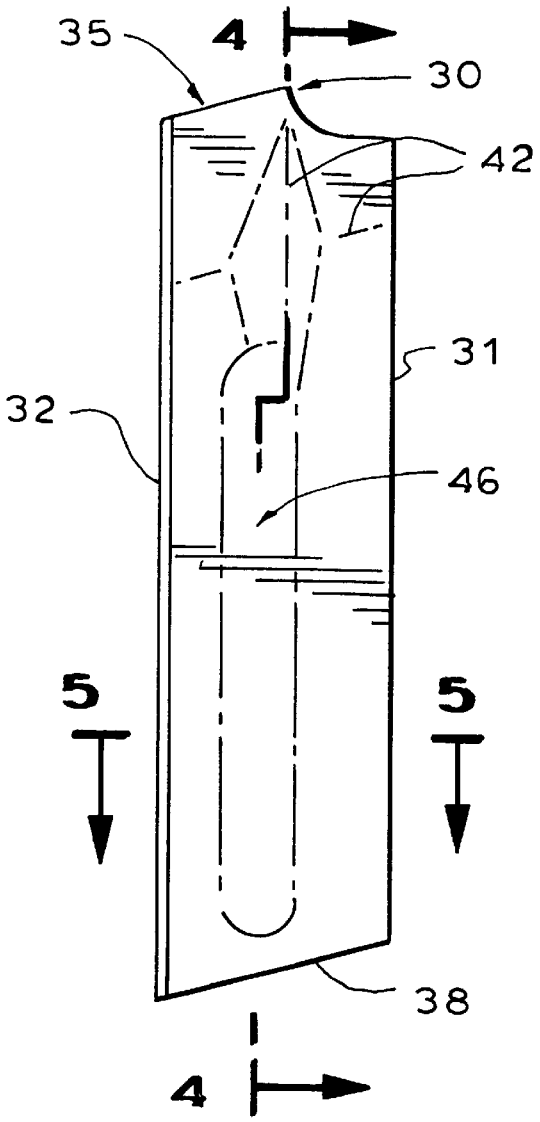
FIG. 3 is a side elevational view of a cartridge having the general overall form of a fifteen round cartridge for, for example, a 9 millimeter Beretta handgun in which the capacity of the magazine has been limited to ten rounds in accordance with the principles of the invention.

Referring now to FIG. 3, the new magazine 30 of the present invention is adapted to slip into the handgrip of a Beretta nine millimeter pistol, for example the Beretta 92S or Beretta M2 pistol of the type presently in wide use by many military organizations throughout the world as well as many police departments throughout the country. The magazines for such Beretta weapons typically are configured to hold fifteen rounds. The new magazine 30 comprises a front wall 31, a parallel rear wall 32, and side walls 33 and 34. Front and rear walls 31 and 32 are generally parallel to one another and planar in configuration while side walls 33 and 34 are likewise generally planar in configuration. The walls 31, 32, 33, and 34 are directed inwardly and upwardly so as to form a discharge opening 35 at the top of the magazine 30 where the individual rounds of the magazine are urged one by one under the bias of a spring-loaded follower 36 into the firing chamber 24 of the pistol slide 23 for firing when the cartridges are struck by firing pin 22. A bottom plate 37 engages flanges 38 at the lower edges of walls 33, 34 to close off the magazine in known fashion.

The outer profile of the magazine 30 is generally similar in configuration to that of the magazine 11 and therefore it will latch into 92S pistols as 15 round magazines and may be removed in the same manner.

In accordance with the principles of the invention, side walls 33, 34 of the magazine 30 are provided with vertical longitudinally extending indentions 40, 41 (see FIG. 5) generally arcuate configuration which extend as shown in FIG. 3 for substantially the full length of the magazine, intersecting at its upper end a generally diamond shaped indentation 42 which extends from the top of the indentations 40 to the discharge opening 35.

As can be determined from inspecting the drawings and the relative dimensions and the features of the magazine 30, it can be appreciated that the interior portions of the side walls 33, 44 are preferably spaced apart a distance of about 1.9 times the diameter of the rounds and that the longitudinally-extending indentations 40, 41 are preferably spaced apart a distance of about 1.3 times the diameter of one of the rounds, thereby substantially reducing the capacity of the cartridge.

Figure 4:
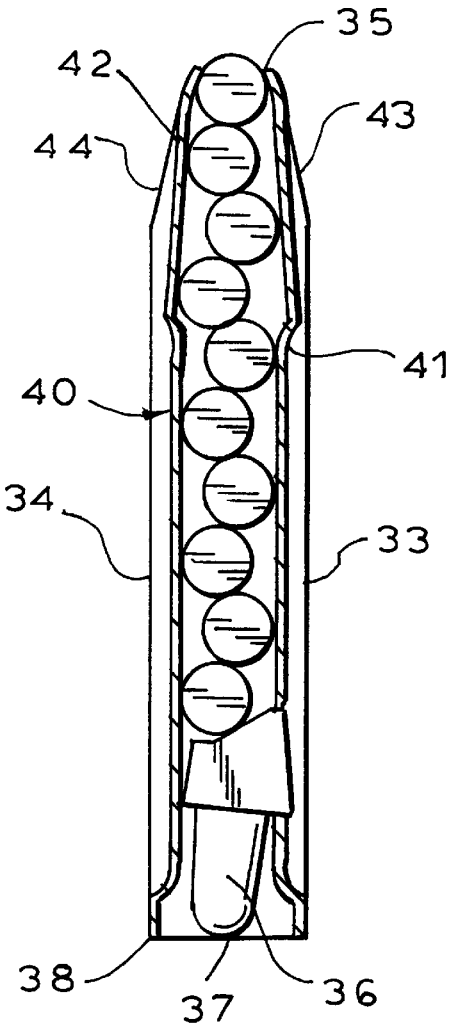
FIG. 4 is a cross sectional view of the magazine of FIG. 3 taken along line 4—4 thereof and showing the reduction in magazine volume and specific geometry to limit the magazine capacity to ten cartridges arrayed in a single sinuous file.
Figure 5:
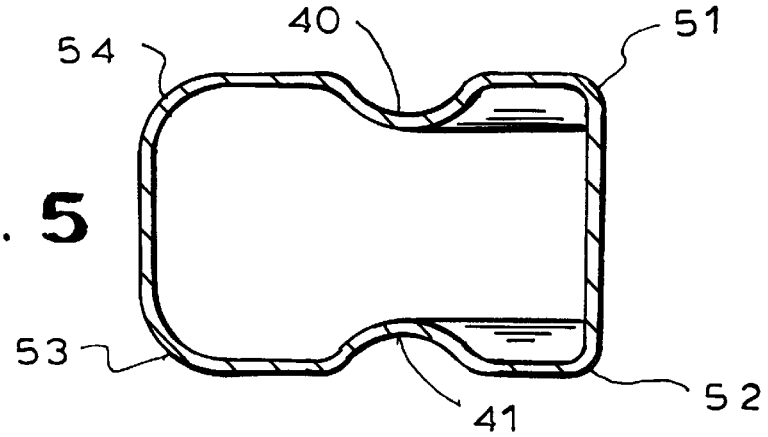
FIG. 5 is an enlarged cross section of the new magazine of FIG. 3 taken along line 5—5 thereof, showing the arcuate configuration of the side wall indentation which provides the necessary restriction in capacity to limit the total volume to ten cartridges and to control the array of the ten cartridges into the desired single sinuous file shown in FIG. 4.

In accordance with the principles of the invention, the magazine 30 is made in a series of cold stamping steps from a flat piece of steel which is cold worked in a series of steps to evolve into the open tubular shape magazine illustrated in FIGS. 3, 4, and 5. More specifically, the flat sheet is stamped first with the indentations 40, 41, and 42 and the inwardly sloped upper sidewall portions 43, 44. Then the flat sheet is folded along vertical axes 51, 52, 53, and 54 representing the four corners of the tubular cross section of the magazine as shown in FIG. 5. In this manner, a flat cold stamped sheet is stamped and bent into the shape of the magazine shown in FIG. 4, the opposite free end edges of the sheet from which the stamping is made being joined at one of the vertical axes 51 through 54 and being welded along a vertical seam to close the magazine and to complete its formation.

Although the foregoing description has been given by way of a preferred embodiment, it will be understood by those skilled in the art that other forms of the invention falling within the ambit of the following claims is contemplated. Accordingly, reference should be made to the following claims in determining the full scope of the invention.

I claim:

1. A limited capacity firearm magazine for a firearm configured to receive a magazine having a capacity of a predetermined large number of rounds, said limited capacity magazine comprising:

(a) an exterior shape acceptable and removable from said firearm;

(b) a discharge opening;

(c) two opposed side walls;

(d) a follower having a bottom position wherein said follower is operable to urge said rounds toward said discharge opening;

(e) a cartridge holding volume partially bounded by said opposed side walls, said discharge opening and said follower, when said follower is in said bottom position;

(f) said two opposed side walls having longitudinal indentations projecting into said holding volume;

(g) said indentations having lower portions extending upward from adjacent said follower, when said follower is in said bottom position, toward said discharge opening and extending along a substantial length of said cartridge holding volume;

(h) said side walls having primary portions spaced a distance sufficient, in the absence of said lower portions of said indentations, for said holding volume to accept said predetermined large number of rounds; and (i) said lower portions of said indentations being sized and shaped to substantially reduce the number of rounds which can be inserted into said cartridge holding volume;

(j) said indentations further comprise upper portions extending downward from said discharge opening to said lower portions;

(k) said upper portions of said indentations are angled upward and inward toward one another;

(l) said upper portions, at points adjacent said lower portions, are spaced at distances greater than a distance between said lower portions, and, at points adjacent said discharge opening, are spaced at distances less than said distance between said lower portions;

(m) whereby said lower portions form a limited capacity storage section and said upper portions form a transition section adapted for the smooth transition of rounds to said discharge opening.

2. A limited capacity firearm magazine as in claim 1 wherein said upper and lower portions intersect; said lower portion being substantially arcuate-shaped, and said upper portion being substantially diamond-shaped.

3. A limited capacity firearm magazine as in claim 2 wherein said upper and lower portions of each said indentation are aligned with different longitudinal axes such that they intersect in an offset manner.

4. A limited capacity firearm magazine as in claim 3 further comprising a front wall toward which said rounds point; and wherein said upper portion of each said indentation is aligned closer to said front wall than an associated lower portion.

5. A limited capacity firearm magazine as in claim 1 wherein:

(a) said primary portions of said side walls are spaced from one another a distance of about 1.9 times a diameter of one of said rounds;

(b) said lower portions of said indentations are spaced from one another at a substantially constant distance along substantially their entire length; and (c) said substantially constant distance between said lower portions of said indentations being about 1.3 times said diameter of said round.

6. A method of making a limited capacity firearm magazine for a firearm configured to receive a magazine having a capacity of a predetermined large number of rounds, said method comprising:

(a) providing a section of sheet metal;

(b) stamping, in said section of sheet metal, two longitudinal indentations and two sloping upper wall sections;

(c) bending said section of sheet metal along three vertical axes forming a tubular section with a discharge opening and two opposed side walls, said two opposed sidewalls having said longitudinal indentations projecting inwardly therefrom;

(d) bonding opposed free edges of said sheet metal to enclose said tubular section;

(e) providing a follower in said tubular section, said follower, in a bottom position, being operable to urge said rounds toward said discharge opening;

(f) providing said tubular section with a cartridge holding volume partially bounded by said two opposed side walls, said discharge opening and said follower, when said follower is in said bottom position;

(g) providing said indentations with lower portions extending from adjacent said follower, when said follower is in said bottom position, toward said discharge opening and extending along a substantial length of said cartridge holding volume;

(h) providing said side walls with primary portions spaced a distance sufficient, in the absence of said lower portions of said indentations, for said holding volume to accept said predetermined large number of rounds;

(i) providing said lower portions of said indentations being sized and shaped to substantially reduce the number of rounds which can be inserted into said limited capacity firearm magazine;

(j) said lower portions of said indentations being spaced from one another at a substantially constant distance along substantially their entire length;

(k) providing said indentations with upper portions extending downward from adjacent said discharge opening to said lower portions;

(l) providing said upper portions of said indentations being angled upward and inward toward one another with respect to said follower:

(m) providing said upper portions, at points adjacent said lower portions, being spaced at distances greater than said substantially constant distance between said lower portions, and, at points adjacent said discharge opening, being spaced at distances less than said substantially constant distance between said lower portions; and (n) whereby said lower portions form a limited capacity storage section and said upper portions form a transition section adapted for the smooth transition of rounds to said discharge opening.

7. The method of claim 6 further comprising:

(a) providing said primary portions of said side walls being spaced from one another a distance of about 1.9 times a diameter of one of said rounds; and (b) providing said substantially constant distance between said lower portions of said indentations being about 1.3 times said diameter of said round.

8. The method of claim 7 further comprising:

(a) providing said upper and lower portions intersect; and (b) providing said lower portions being substantially arcuate-shaped, and said upper portions being substantially diamond-shaped.

9. The method of claim 8 further comprising providing said upper and lower portions of each said indentation being aligned with different longitudinal axes such that they intersect in an offset manner.

10. The method of claim 9 further comprising providing a front wall toward which said rounds point; and providing said upper portion of each said indentation being aligned closer to said front wall than the associated lower portion.

* * * * *